US005223361A

United States Patent [19]

Mishra et al.

[11] Patent Number: 5,223,361

[45] Date of Patent: Jun. 29, 1993

[54] MULTILAYER ELECTROPHOTOGRAPHIC IMAGING MEMBER COMPRISING A CHARGE GENERATION LAYER WITH A COPOLYESTER ADHESIVE DOPANT

[75] Inventors: Satchidanand Mishra; Robert C. U. Yu; Leon A. Teuscher, all of Webster, N.Y.; Andrea G. Holland, Charlotte, N.C.

[73] Assignee: Xerox Corporation, Stamford, Conn.

[21] Appl. No.: 575,549

[22] Filed: Aug. 30, 1990

[51] Int. Cl.[5] ..... G03G 5/04; G03G 5/047

[52] U.S. Cl. ..... 430/58; 430/96; 430/108

[58] Field of Search ..... 430/58, 59, 96, 108

[56] References Cited

U.S. PATENT DOCUMENTS

| | | | |
|---|---|---|---|
| 3,121,006 | 2/1964 | Middleton et al. | 96/1 |
| 3,357,989 | 12/1967 | Byrne et al. | 260/314.5 |
| 3,442,781 | 5/1969 | Weinberger | 204/181 |
| 3,887,369 | 6/1975 | Matsuno et al. | 96/1.5 |
| 3,888,667 | 6/1975 | Lee | 96/1.5 |
| 3,891,435 | 6/1975 | Lee | 96/1.5 |
| 4,081,274 | 3/1978 | Horgan | 96/1 PC |
| 4,082,551 | 4/1978 | Steklenski et al. | 96/1 PC |
| 4,150,987 | 4/1979 | Anderson et al. | 96/1.5 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,391,888 | 7/1983 | Chang et al. | 430/57 |
| 4,415,639 | 11/1983 | Horgan | 430/57 |
| 4,521,457 | 6/1985 | Russell et al. | 427/286 |
| 4,576,981 | 5/1986 | Hilger et al. | 524/40 |
| 4,664,995 | 5/1987 | Horgan et al. | 430/59 |
| 4,786,570 | 11/1988 | Yu et al. | 430/58 |
| 4,853,308 | 8/1989 | Ong et al. | 430/59 |
| 4,943,508 | 7/1990 | Yu | 430/58 |
| 5,021,309 | 6/1991 | Yu | 430/58 |
| 5,030,533 | 7/1991 | Bluhm et al. | 430/59 |

*Primary Examiner*—Marion E. McCamish
*Assistant Examiner*—S. Rosasco
*Attorney, Agent, or Firm*—Oliff & Berridge

[57] ABSTRACT

An electrophotographic imaging member provided with a supporting substrate, a conductive layer, a charge blocking layer, an optional adhesive layer, a charge generating layer and a charge transport layer, wherein the charge generating layer contains a photogenerating pigment and a copolyester adhesive dopant blended into a film-forming polymer binder. The doping of the charge generating layer with a copolyester adhesive permits the elimination of the need of the optional adhesive layer for effective cost saving measure. If the adhesive layer is provided, the adhesion strength between the charge generating layer and the adhesive layer is significantly enhanced by up to about four times.

25 Claims, 1 Drawing Sheet

MULTILAYER ELECTROPHOTOGRAPHIC IMAGING MEMBER COMPRISING A CHARGE GENERATION LAYER WITH A COPOLYESTER ADHESIVE DOPANT

BACKGROUND OF THE INVENTION

This invention relates in general to electrophotography and, in particular, to electrophotoconductive imaging members having multiple layers.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotograhic plate to a support such as a paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors.

During machine function, a photoconductive imaging member is constantly under repetitive electrophotographic cycling which subjects the electrically operative layers to high electrical charging/discharging cycles, multiple exposures to light for latent imaging development and erasure, and heat due to temperature elevation as a result of machine operation. The repetitive electrical and light fatigue lead to a gradual deterioration in the electrical characteristics of the imaging member, and limit its service life in the field. In the attempt to fabricate a robust photoconductive imaging system, many innovative ideas have been attempted with the intent to overcome this shortfall and extend the electrical functional life of the imaging member.

Modern composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, and a charge transport layer. This photoreceptor may also comprise additional layers such as an anti-curl layer and an optional overcoating layer.

One problem associated with multilayer electrophotographic imaging members is delamination. Since the various layers of a multilayer electrophotographic imaging member contain differing materials, the adhesion of those materials will vary. In particular, it is desirable to provide an adhesive layer between the charge blocking layer and the charge generating layer since adequate adhesion is not possible when certain materials are used for these layers. In particular, a charge generating layer comprising a polycarbonate, a polyvinylcarbazole, a polyvinylbutyral, or a polystyrene-butadiene copolymer binder does not adhere well to a silane charge blocking layer. Thus, the adhesive layer is provided to improve adhesion. However, although adhesion is improved with the use of an adhesive layer, the adhesive layer is not always adequate in providing the necessary adhesion.

A number of materials have been provided for the adhesive layer. For example, copolyesters such as du Pont 49,000 resin available from E.I. du Pont de Nemours & Company and Vitel PE-100 resin available from Goodyear Rubber and Tire Company, are commonly employed. With such copolyesters, adhesion may be increased in proportion with the thickness of the layer. However, the adhesion no longer increases once a particular thickness is obtained. Thus, although these copolyesters provide improved adhesion, the adhesion strength is still limited by the thickness of the adhesive layer, and there is always a need to further enhance this adhesion for mechanically robust imaging member performance.

The above-described copolyester resins have also been utilized as binders in the charge generating layer. For example, U.S. Pat. No. 4,415,639 to Horgan discloses in Example VI a photoconductive layer consisting of du Pont 49,000 polyester and vanadyl phthalocyanine coated upon an adhesive layer of du Pont 49,000 adhesive. However, the use of a material such as du Pont 49,000 as a binder in the charge generating layer has a number of problems. For example, the du Pont 49,000 resin binder does not adequately disperse photogenerating pigment, in particular trigonal selenium pigment, to warrant proper electrophotographic function.

The provision of an adhesive layer between the charge blocking layer and the charge generating layer is required, though undesirable since it involves an additional coating step in the fabrication of an electrophotographic imaging member. The additional coating step not only increases the time required to fabricate an imaging member, it also increases costs due to the requirement of additional materials, labor, and a decrease in production throughput. Since the need for the adhesive layer is not for assisting electrophotographic function but is for the mechanical purpose of linking the charge blocking layer to the charge generating layer, it would be economical if an electrophotographic imaging member could be fabricated without the requirement of the adhesive layer.

In electrophotographic imaging member fabrication, unfortunately, an adhesive layer is always required in connection with some charge generating layer compositions utilized with particular charge blocking layers. For example, polyvinylcarbazole is one of very few binders known to disperse selenium and selenium alloys which are commonly used in forming photogenerating layers. Polyvinylcarbazole does not adhere very well to certain charge blocking layers, especially charge blocking layers containing silanes. Since there are practically no alternatives other than using polyvinylcarbazole, polyvinylbutyral, polystyrene or polystyrene-butadiene copolymer to disperse the selenium, the adhesive layer has been absolutely required. Even then, adhesion of the charge generating layer is not always adequate to guarantee mechanical integrity during function.

U.S. Pat. No. 4,853,308 to Ong et al discloses a layered photoresponsive imaging member comprised of a supporting substrate, a photogenerating layer, and a hole transport layer comprised of bis(-diarylamino) fluorenes. The charge generating layer, as disclosed in Example X, may comprise a squaraine compound dispersed in Vitel PE-200 polyester from Goodyear.

U.S. Pat. No. 4,576,981 to Hilger et al discloses an adhesive composition comprising a copolyester containing at least one copolymer of vinylidene chloride, preferably in a weight ratio of about 3:1 to 1:1. The adhesive composition is disclosed as being suitable for use particularly on a polyester film.

U.S. Pat. No. 3,887,369 to Matsuno et al discloses an organic photoconductive element with an interlayer and adhesion promoting additive. In particular, a barrier layer comprised mainly of copolymers comprising alkyl vinyl ethers and maleic anhydride or of composites of alkyl vinyl ethers/alkyl half esters of maleic acid copolymers and polyvinyl pyrrolidone or copolymers thereof, is provided between a substrate and an organic photoconductive layer. The photoconductive layer adhesion is improved by incorporating vinylidene chloride/acrylic ester copolymers into the organic photoconductive layer.

U.S. Pat. No. 4,391,888 to Chang et al discloses multilayered organic photoconductive elements comprising a layer of polycarbonate resin which is capable of functioning as a barrier layer to prevent charge leakage, and as a bonding layer.

While the above-mentioned electrophotographic imaging members provide a number of alternatives for preparing electrophotographic imaging devices, there continues to be a need for multilayer electrophotographic imaging members which resist delamination. In particular, there continues to be a need for electrophotographic imaging members comprising a photoconductive layer comprised of selenium or selenium alloys which is capable of adhering to a charge blocking layer, especially a charge blocking layer formed from silanes.

SUMMARY OF THE INVENTION

It is an object of the invention to provide a materials combination for the layers in a multilayer imaging device which overcomes the problems of the prior art.

It is another object of the invention to eliminate the need for an adhesive layer between a charge blocking layer and a charge generating layer in an electrophotographic imaging member.

It is also an object of the invention to provide a multilayer imaging member having improved adhesion between layers.

It is yet another object of the invention to improve adhesion of layers in a multilayer imaging device without adversely affecting the mechanical and electrical integrities of the device.

The present invention provides an electrophotographic imaging member comprising a supporting substrate, a conductive layer, a charge blocking layer, an optional adhesive layer, a charge generating layer and a charge transport layer. In particular, the charge generating layer comprises photogenerating pigment, such as selenium or a selenium alloy, dispersed in a film forming binder, such as polyvinylcarbazole, polyvinylbutyral, polystyrene, or polystyrene-butadiene, which additionally contains a polymer adhesive, such as a copolyester. In one embodiment, the need for an adhesive layer is eliminated by doping the charge generating layer with a copolyester adhesive. In another embodiment of the invention, an adhesive layer is provided comprising a copolyester resin, and the charge generating layer is doped with the same copolyester resin or a similar copolyester resin. Very importantly, the copolyester resin is chemically similar or the same as the adhesive layer to facilitate bonding, and it should also be capable of blending with the film forming binder used for the charge generating layer to prevent phase separation without disturbing the selenium dispersion.

BRIEF DESCRIPTION OF THE DRAWING

A more complete understanding of the present invention can be obtained by reference to accompanying FIG. 1, which is a cross-sectional view of a multilayered photoreceptor of the invention.

DESCRIPTION OF PREFERRED EMBODIMENTS

Figure 1:
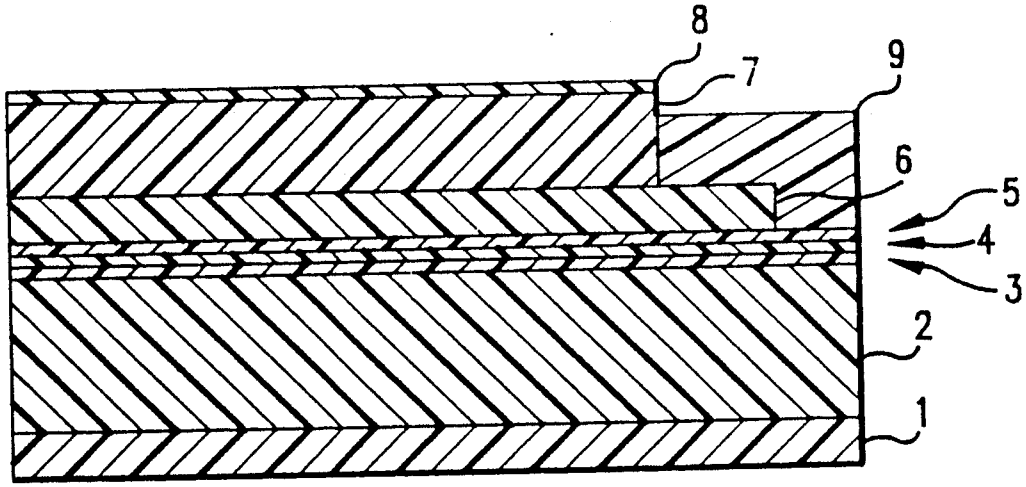

The present invention increases adhesion of layers in an electrophotographic imaging member, and in particular, increases the adhesion of a charge generating layer to a charge blocking layer or an optional adhesive layer. The increased adhesion of layers is obtained without adverse effects on the electrical and mechanical integrities of the imaging member. In particular, a charge generating layer is doped with an adhesive additive, such as a copolyester adhesive.

In one embodiment of the present invention, an electrophotographic imaging member is provided comprising a supporting substrate, a conductive layer, a charge blocking layer, a charge generating layer and a charge transport layer. An adhesive layer between the charge generating layer and the charge blocking layer is not required since the charge generating layer is doped with an adhesive material such as a copolyester resin. In one particularly preferred embodiment, a charge generating layer is provided comprising a polyvinylcarbazole binder, selenium or selenium alloy, and the adhesive material.

In another embodiment of the invention, an electrophotographic imaging member is provided having improved adhesion comprising a supporting substrate, a conductive layer, a charge blocking layer, an adhesive layer, a charge generating layer and a charge transport layer. In this embodiment, the charge generating layer is doped with an adhesive material as in the above-described first embodiment. Since the same materials or materials having similar chemical constituents will adhere to each other, a choice of adhesive materials for the adhesive layer and the doping of the charge generating layer is made based on this fact to provide improved adhesion strength.

A representative structure of an electrophotographic imaging member of the present invention is shown in FIG. 1. This imaging member is provided with an anti-curl layer 1, a supporting substrate 2, an electrically conductive ground plane 3, a hole blocking layer 4, an optional adhesive layer 5, a charge generating layer 6, and a charge transport layer 7. An optional overcoating layer 8 is also shown in FIG. 1.

In the above-described device, a ground strip 9 is preferably provided adjacent the charge transport layer at an outer edge of the imaging member. See U.S. Pat. No. 4,664,995. The ground strip 9 is coated adjacent to the charge transport layer so as to provide grounding contact with a grounding device (not shown) during electrophotographic processes.

A description of the layers of the electrophotographic imaging member of the present invention shown in FIG. 1 follows.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex available from ICI Americas Inc.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, less than 200 micrometers, or of minimum thickness, for example more than 50 micrometers, provided there are no adverse effects on the final photoconductive device. The surface of the substrate layer is preferably cleaned prior to coating to promote greater adhesion of the deposited conductive coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface to the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively-charged photoreceptors, any suitable hole blocking layer capable of forming a barrier to prevent hole injection from the conductive layer to the opposite photoconductive layer may be utilized. The hole blocking layer may include polymers such as polyvinylbutyral, epoxy resins, polyesters, polysiloxanes, polyamides, polyurethanes and the like, or may be nitrogen-containing siloxanes or nitrogen-containing titanium compounds such as trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)-titanate, titanium-4-amino benzene sulfonate oxyacetate, titanium 4-aminobenzoate isostearate oxyacetate, $[H_2N(CH_2)_4]CH_3Si(OCH_3)_2$ (gamma-aminobutyl methyl diethoxy silane), $[H_2N(CH_2)_3]CH_3Si(OCH_3)_2$ (gamma-aminopropyl) methyl diethoxy silane), and $[H_2N(CH_2)_3]Si(OCH_3)_3$ (gamma-aminopropyl triethoxy silane) as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

I

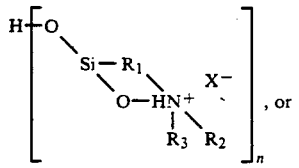

, or

II

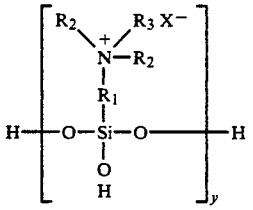

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Optional Adhesive Layer

Intermediate layers between the blocking layer and the charge generating or photogenerating layer may be desired to promote adhesion. For example, the adhesive layer 5 may be employed. If such layers are utilized, they preferably have a dry thickness between about 0.01 micrometer to about 0.3 micrometer, more preferably about 0.05 to about 0.2 micrometer. Typical adhesive layers include film-forming polymers such as polyester, du Pont 49,000 resin (available from E.I. du Pont de Nemours & Co.), Vitel PE-100 (available from Goodyear Rubber & Tire Co.), polyvinylbutyral, polyvinylpyrrolidone, polyurethane, polymethyl methacrylate, and the like. Both the du Pont 49,000 and Vitel PE-100 adhesive layers are preferred because they provide reasonable adhesion strength and produce no deleterious electrophotographic impact on the resulting imaging members.

Du Pont 49,000 is a linear saturated copolyester of four diacids and ethylene glycol having a molecular weight of about 70,000 and a glass transition temperature of 32° C. Its molecular structure is represented as $$HO-\overset{O}{\overset{\|}{C}}-[\text{Diacid-Ethylene glycol}]_n-OH$$

where n is a number which represents the degree of polymerization and gives a molecular weight of about 70,000. The ratio of diacid to ethylene glycol in the copolyester is 1:1. The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000 and a glass transition temperature of 71° C. Its molecular structure is represented as $$HO-\overset{O}{\overset{\|}{C}}-[\text{Diacid-Ethylene glycol}]_n-OH$$

where n is a number which represents the degree of polymerization and gives a molecular weight of about 50,000. The ratio of diacid to ethylene glycol in the copolyester is 1:1. The two diacids are terephthalic acid and isophthalic acid in a ratio of 3:2.

The fact that du Pont 49,000 and Vitel PE-100 are chemically similar is very important because they can be easily mixed to form a polymer blend. When coated over the top of the other, they adhere to each other so strongly that they become practically inseparable. Accordingly, it is preferred to use such chemically similar compounds because of their highly miscible and highly adhesive properties with one another.

The Charge Generating Layer

The charge generating (photogenerating) layer 6 of the invention may be applied to the adhesive layer 5 or directly to the charge blocking layer 4 if an adhesive layer is not used. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal-free phthalocyanine described in U.S. Pat. No. 3,357,989, metal phthalocyanines such as vanadyl phthalocyanine and copper phthalocyanine; dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; benzimidazole perylene; substituted 2,4-diamino-triazines such as those disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal-free phthalocyanine and tellurium alloys are also preferred because these materials provide the additional benefit of being sensitive to infrared light.

Any suitable polymeric film-forming binder material may be employed as the matrix in the photogenerating layer. Typical polymeric film-forming materials include those described, for example, in U.S. Pat. No. 3,121,006. When an adhesive layer is used, the binder polymer should dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer. The adhesive material added to these photogenerating compositions should be compatible with the binder polymer, and preferably is the same or chemically similar to the polymer of the adhesive layer.

The photogenerating composition or pigment may be present in the resinous binder composition and comprises binder resin and the adhesive polymer promoter dopant in various amounts with respect to each other. Generally, from about 5 percent by volume to about 90 percent by volume of the photogenerating pigment is dispersed in about 95 percent by volume to about 10 percent by volume of the resinous binder. Preferably from about 20 percent by volume to about 30 percent by volume of the photogenerating pigment is dispersed in about 80 percent by volume to about 70 percent by volume of the resinous binder composition. However, when trigonal selenium photogenerating pigment is used, only a low pigment concentration of about 8 percent by volume is acceptable to give good quality coating due to the coating difficulty associated with high selenium loading. In the present invention embodiments, about 8 percent by volume of the trigonal selenium photogenerating pigment is dispersed in about 92 percent by volume of the resinous binder composition.

Since an adhesive layer is physically situated above the silane blocking layer and below the charge generating layer, it therefore has two linking interfaces. As described in the teachings of U.S. Pat. No. 4,786,570 to Yu et al, the bonding of the adhesive layer to the silane is of a chemical nature through the formation of an acid-base bond between the organic acids of the adhesive layer and the amino functional group of the silane blocking layer. This bonding is further supplemented by nucleophillic interaction to produce an extremely durable interfacial adhesion strength. To facilitate direct bonding of the charge generating layer to the silane blocking layer when the coating of the adhesive layer is to be omitted, direct addition of the adhesive material to the charge generating layer is a viable approach to produce a reasonable bond strength to the silane blocking layer through the above-described bonding mechanism. However, it is important to emphasize that the amount of adhesive material added to the charge generating layer should neither implicate the homogeneous dispersion of the selenium particles in the charge generating layer nor cause gross polymer phase separation between the binder and the adhesive material to insure proper electrophotographic function of the resulting imaging device.

In the present invention, an adhesive material is doped in the photogenerating composition. Polyester, for example, copolyester adhesives such as du Pont 49,000, and Goodyear polyesters such as Vitel PE-100, Vitel PE-200, Vitel PE-5571AG, Vitel VPE-5545A, and Vitel VPE-5833 and the like may be present in the photogenerating layer. The addition of the adhesive in a sufficient amount may permit the elimination of the need for the optional adhesive layer 5. If the optional adhesive layer 5 is not used, the copolyester should be added to the charge generating composition in an amount ranging from about 3 to about 30 volume percent, preferably from about 5 to about 15 volume percent with respect to the binder polymer. For example, du Pont 49,000 resin may be added to the charge generating composition in an amount between about 5 and about 15 volume percent. A particularly preferred charge generating layer composition of the invention comprises about 98 volume percent to about 60 volume percent polyvinylcarbazole, about 5 volume percent to about 20 volume percent selenium, and about 3 volume percent to about 20 volume percent copolyester adhesive such as du Pont 49,000. This combination of materials for the charge generating layer permits the elimination of the adhesive layer, since it provides adequate adhesion to the underlying blocking layer.

If the optional adhesive layer 5 is employed, improved adhesion may be provided by doping the charge generating layer with an adhesive material such as a copolyester adhesive. For example, a charge generating composition of polyvinylcarbazole and selenium may be doped with about 0.5 volume percent to about 20 volume percent of du Pont 49,000. The lower limit of this range is the minimum amount of copolyester required for obtaining adequate adhesion enhancement. The higher limit of this range is selected to give the best adhesion results and to avoid polymer phase separation. These adhesive-doped charge generating layers may be used in combination with an adhesive layer of, for example, Vitel PE-100 or du Pont 49,000. For example, a charge generating composition doped with Vitel PE-100 may be applied to an adhesive layer comprising Vitel PE-100 or du Pont 49,000. Likewise, a charge generating composition doped with du Pont 49,000 may be applied to an adhesive layer comprising Vitel PE-100 or du Pont 49,000. Thus, the adhesives used for doping the charge generating compositions and for use as an adhesive layer may be the same or different.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers to give equivalent pigment coverage for identical photogeneration capability. Thicknesses outside these ranges can be selected, providing the objectives of the present invention are achieved.

Charge generating layers doped with adhesive material of the invention permit adequate adhesion linkage directly to the charge blocking layer, especially a silane charge blocking layer below, without the need for the optional adhesive layer. Provision of the adhesive layer permits increased adhesion compared to charge generating layers which are not doped. Further, the electrical and mechanical integrities of the electrophotographic imaging member containing a doped generating layer are maintained.

Any suitable and conventional technique may be utilized to mix and thereafter apply the photogenerating layer coating mixture to the previously dried silane blocking layer or the adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The Charge Transport Layer

The charge transport layer 7 may comprise any suitable transparent organic polymer or non-polymeric material capable of supporting the injection of photogenerated holes and electrons from the charge generating layer 6 and allowing the transport of these holes or electrons through the organic layer to selectively discharge the surface charge. The charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a substantially non-photoconductive material which supports the injection of photogenerated holes from the charge generating layer. The charge transport layer is normally transparent when exposure is effected therethrough to ensure that most of the incident radiation is utilized by the underlying charge generating layer. When used with a transparent substrate, imagewise exposure or erase may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds dispersed in normally electrically inactive polymeric materials for making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge transporting aromatic amine compound, and about 75 percent to about 25 percent by weight of a polymeric film-forming resin in which the aromatic amine is soluble.

The charge transport layer is preferably formed from a mixture comprising an aromatic amine compound of one or more compounds having the general formula:

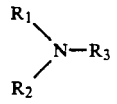

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

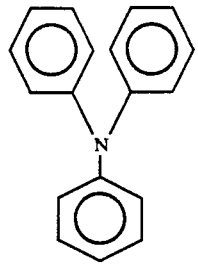

II. Bis and poly triarylamines such as:

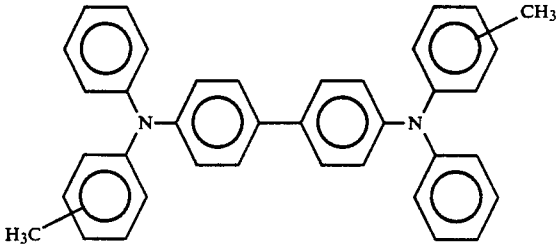

III. Bis arylamine ethers such as:

-continued

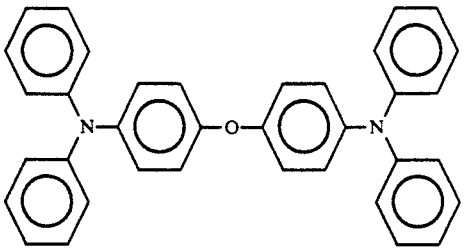

and

IV. Bis alkyl-arylamines such as:

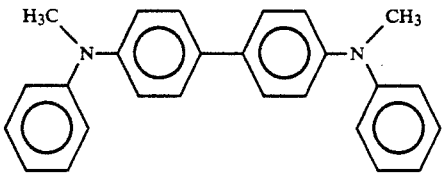

A preferred aromatic amine compound has the general formula:

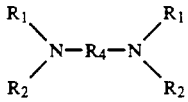

wherein $R_1$ and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4,4'-bis(diethylamino)-2,2'-dimethyltriphenylmethane, N,N'-bis(alkyl-phenyl)-1,1'-biphenyl)-4,4'-diamine wherein the alkyl is, for example, methyl, ethyl, propyl, n-butyl, etc., N,N'-diphenyl-N,N'-bis(3-methylphenyl)-(1,1'biphenyl)-4,4'-diamine, and the like, dispersed in an inactive resin binder.

Any suitable inactive resin binder soluble in methylene chloride or other suitable solvents may be employed, provided that the material used in the adhesive layer is insensitive to the solvent used. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; Makrolon, a polycarbonate resin having a molecular weight of from about 50,000 to about 100,000, available as Makrolon from Farbenfabricken Bayer A.G.; Merlon, a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip may comprise a film-forming polymer binder and electrically conductive particles. Cellulose may be used to disperse the conductive particles. Any suitable electrically conductive particles may be used in the electrically conductive ground strip layer of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer is from about 3 micrometers to about 35 micrometers, and preferably about 14 micrometers.

The Overcoating Layer

The optional overcoating layer 8 may comprise organic polymers or inorganic polymers that are capable of transporting charge through the overcoat. The overcoating layer may range in thickness from about 2 micrometers to about 8 micrometers, and preferably from about 3 micrometers to about 6 micrometers. An optimum range of thickness is from about 3 micrometers to about 5 micrometers.

The invention will further be illustrated in the following, non-limiting examples, it being understood that these examples are intended to be illustrative only and that the invention is not intended to be limited to the materials, conditions, process parameters and the like recited therein.

COMPARATIVE EXAMPLE I

A photoconductive imaging member is prepared by providing a web of titanium coated with a biaxially oriented PET (Melinex, available from ICI Americas Inc.) substrate having a thickness of 3 mils, and applying thereto, with a gravure applicator using a production coater, a solution containing 50 grams 3-amino-propyl triethoxysilane, 15 grams acetic acid, 684.8 grams of 200 proof denatured alcohol and 200 grams heptane. This layer is then dried for about 5 minutes at 135° C. in the forced air drier of the coater. The resulting blocking layer has a dry thickness of 0.05 micrometer.

An adhesive interface layer is then prepared by applying a wet coating over the blocking layer, using a gravure applicator, containing 2.5 percent by weight based on the total weight of the solution of copolyester adhesive (du Pont 49,000, available from E.I. du Pont de Nemours & Co.) in a 70:30 volume ratio mixture of tetrahydrofuran/cyclohexanone. The adhesive interface layer is then dried for about 5 minutes at 135° C. in the forced air drier of the coater. The resulting adhesive interface layer has a dry thickness of 0.05 micrometer.

The adhesive interface layer is thereafter coated with a photogenerating layer containing 7.5 percent by diphenyl-N,N'-bis(3-methylphenyl)-1,1'-biphenyl-4,4,'-diamine, and 67.5 percent by volume polyvinylcarbazole. This photogenerating layer is prepared by introducing 80 grams polyvinylcarbazole to 1400 ml of a 1:1 volume ratio of a mixture of tetrahydrofuran and toluene. To this solution are added 80 grams of trigonal selenium and 10,000 grams of ⅛ inch diameter stainless steel shot. This mixture is then placed on a ball mill for 72 to 96 hours. Subsequently, 500 grams of the resulting slurry are added to a solution of 36 grams of polyvinylcarbazole and 20 grams of N,N'-diphenyl-N,N'-bis(3-methylphenyl)-1,1'-biphenyl-4,4'-diamine in 750 ml of 1:1 volume ratio of tetrahydrofuran/toluene. This slurry is then placed on a shaker for 10 minutes. The resulting slurry is thereafter applied to the adhesive interface with an extrusion die to form a layer having a wet thickness of about 0.5 mil. However, a strip about 3 mm wide along one edge of the substrate, blocking layer and adhesive layer is deliberately left uncoated by any of the photogenerating layer material to facilitate adequate electrical contact by the ground strip layer that is applied later. This photogenerating layer is dried at 135° for 5 minutes in the forced air oven of the coater to form a photogenerating layer having a dry thickness of 2.3 micrometers.

This coated member is simultaneously overcoated with a charge transport layer and a ground strip layer by coextrusion of the coating materials through adjacent extrusion dies similar to the dies described in U.S. Pat. No. 4,521,457. The charge transport layer is prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbenfabricken Bayer A.G. The resulting mixture is dissolved by adding methylene chloride. This solution is applied on the photogenerator layer by extrusion to form a coating which upon drying has a thickness of 24 micrometers.

The strip about 3 mm wide left uncoated by the photogenerator layer is coextruded as a ground strip layer along with the charge transport layer. The ground strip layer coating mixture is prepared by combining 525 grams of polycarbonate resin (Makrolon 5705, available from Bayer AG), and 7,317 grams of methylene chloride in a carboy container. The container is covered tightly and placed on a roll mill for about 24 hours until the polycarbonate is dissolved in the methylene chloride. The resulting solution is mixed for 15–30 minutes with about 2,072 grams of a graphite dispersion (12.3 percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade disperser (Tekmar Dispax Disperser) in a water cooled, jacketed container to prevent the dispersion from overheating and losing solvent. The resulting dispersion is then filtered and the viscosity is adjusted to between 325–375 centipoises with the aid of methylene chloride. This ground strip layer coating mixture is then applied to the photoconductive imaging member to form an electrically conductive ground strip layer having a dried thickness of about 15 micrometers.

During the transport layer and ground strip layer coextrusion coating process, the humidity is equal to or less than 15 percent. The resulting photoreceptor device containing all of the above layers is annealed at 135° C. in the forced air oven of the coater for 6 minutes.

An anti-curl coating is prepared by combining 882 grams of polycarbonate resin (Makrolon 5705, available from Bayer AG), 9 grams of copolyester resin (Vitel PE-100, available from Goodyear Tire and Rubber Co.), and 9,007 grams of methylene chloride in a carboy container to form a coating solution containing 8.9 percent solids. The container is covered tightly and placed on a roll mill for about 24 hours until the polycarbonate and polyester are dissolved in the methylene chloride. The anti-curl coating solution is applied to the rear surface (side opposite the photogenerator layer and charge transport layer) of the photoconductive imaging member by extrusion coating and dried at 135° C. in the forced air oven of the coater for about 5 minutes to produce a dried film having a thickness of 13.5 micrometers.

COMPARATIVE EXAMPLE II

A photoconductive imaging member having two electrically operative layers (the charge generating and the charge transport layers) as described in Comparative Example I is prepared using the same procedures, conditions, and materials except that the coating of the adhesive layer is omitted. Without the adhesive layer to link the charge generating layer to the silane blocking layer, the resulting imaging exhibits spontaneous layer delamination after application of the transport layer coating and drying.

EXAMPLE III

A photoconductive imaging member having two electrically operative layers is fabricated by repeating the procedures and using the same materials as described in Comparative Example II, except that 5 volume percent, based on the total solids, of the polyvinylcarbazole binder is removed from the charge generating layer coating solution and substituted with an equal amount of du Pont 49,000 copolyester adhesive. The amount of the 49,000 copolyester doping in the resulting charge generating layer is 5 percent by volume.

EXAMPLE IV

The same procedure as described in Example III is followed to prepare a photoconductive imaging member, except that the amount of du Pont 49,000 copolyester doping in the dry charge generating layer is 10 percent by volume.

EXAMPLE V

The same procedure as described in Example III is followed to prepare a photoconductive imaging member, except that the amount of du Pont 49,000 copolyester doping in the dry charge generating layer is 15 percent by volume.

EXAMPLE VI

The same procedure as described in Comparative Example I is followed to prepare a photoconductive imaging member, except that 5 volume percent, based on the total solids, of the polyvinylcarbazole binder is removed from the charge generating layer coating solution and replaced with an equal amount of du Pont 49,000 copolyester adhesive. The amount of du Pont 49,000 copolyester doping in the resulting charge generating layer is 5 percent by volume.

EXAMPLE VII

The same procedure as described in Comparative Example VI is followed to prepare a photoconductive imaging member, except that the amount of du Pont 49,000 copolyester doping in the dry charge generating layer is 10 percent by volume.

EXAMPLE VIII

The same procedure as described in Comparative Example VI is followed to prepare a photoconductive imaging member, except that the amount of du Pont 49,000 copolyester doping in the dry charge generating layer is 15 percent by volume.

COMPARATIVE EXAMPLE IX

A photoconductive imaging member having two electrically operative layers as described in Comparative Example I is prepared using the same procedures, materials and conditions, except that the du Pont 49,000 adhesive interlayer is replaced with Vitel PE-100 copolyester adhesive, available from Goodyear Tire & Rubber Company. The Vitel PE-100 adhesive layer coating solution, prepared by dissolving the copolyester in a 70:30 volume ratio mixture of tetrahydrofuran/cyclohexanone to give 2.5 weight percent solids, is applied over the silane blocking layer using a gravure applicator. The wet coating is dried for about 5 minutes at 135° C. in the forced air drier of the coater to yield a Vitel PE-100 adhesive layer having a dry thickness of 0.04 micrometer.

EXAMPLE X

A photoconductive imaging member having two electrically operative layers is prepared by repeating the procedure and using the same materials as described in Comparative Example IX, except that 5 volume percent, based on the total solids, of the polyvinylcarbazole binder in the charge generating layer is replaced by an equal amount of du Pont 49,000 copolyester adhesive. The amount of du Pont 49,000 copolyester doping in the resulting dry charge generating layer is 5 percent by volume.

EXAMPLE XI

The same procedure as described in Example X is followed to prepare a photoconductive imaging member, except that the amount of du Pont 49,000 polyester doping in the dry charge generating layer is 10 percent by volume.

EXAMPLE XII

The same procedure as described in Example X is followed to prepare a photoconductive imaging member, except that the amount of du Pont 49,000 copolyester doping in the dry charge generating layer is 15 percent by volume.

COMPARATIVE EXAMPLE XIII

A photoconductive imaging member having two electrically operative layers as described in Comparative Example IX is prepared using the same procedures, materials and conditions, except that the Vitel PE-100 adhesive layer has a dry thickness of 0.08 micrometer.

EXAMPLE XIV

A photoconductive imaging member having two electrically operative layers is prepared by repeating the procedure and using the same materials as described in Comparative Example XIII, except that 5 volume percent, based on the total solids, of the polyvinylcarbazole binder in the charge generating layer coating solution is replaced by an equal volume of du Pont 49,000 copolyester adhesive. The amount of du Pont 49,000 copolyester doping in the resulting dry charge generating layer is 5 percent by volume.

EXAMPLE XV

The same procedure as described in Example XIV is followed to prepare a photoconductive imaging member, except that the amount of du Pont 49,000 copolyester doping in the dry charge generating layer is 10 percent by volume.

EXAMPLE XVI

The same procedure as described in Example XIV is followed to prepare a photoconductive imaging member, except that the amount of du Pont 49,000 copolyester doping in the dry charge generating layer is 15 percent by volume.

EXAMPLE XVII

The photoconductive imaging members, having the copolyester adhesive doping in the charge generating layer, of the present invention are evaluated for 180° peel strength and examined for selenium dispersion in the resulting charge generating layers to insure its dispersion homogeneity in the invention.

The 180° peel strength is determined by cutting a minimum of five 0.5 inch×6 inches imaging member samples from each of Examples I and III through XVI. Since the imaging member of Comparative Example II having no adhesive layer exhibits spontaneous layer delamination, the peel strength of this imaging member is not measured because it is practically zero. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape. At this condition, the anti-curl layer/substrate of the stripped segment of the test sample can easily be peeled away 180° from the sample to cause the adhesive layer (or silane layer if the adhesive layer is omitted) to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer by the width of the test sample.

The results of 180° peel measurements listed in Table I below show that doping of copolyester adhesive material in the charge generating layer according to the present invention substantially improves the layer's adhesion strength of each resulting photoconductive imaging member by up to 3.7 times enhancement. When the adhesive layer is omitted for cost saving measure, the present invention concept of adhesive doping in the charge generating layer eliminates the spontaneous layer delamination problem and provides reasonably good adhesion bonding of the charge generating layer when coated directly over the silane blocking layer even at a low level of 5 volume percent du Pont 49,000 doping. Increasing the level of du Pont 49,000 doping, between 5 and 15 percent by volume, in the charge generating layer has been observed to linearly increase the peel strength of all the invention imaging members.

TABLE I

| EXAMPLE | PEEL STRENGTH (gm/cm) |
|---|---|
| I (Control) | 4.7 |
| II (Control) | 0* |
| III | 5.0 |
| IV | 6.2 |
| V | 7.5 |
| VI | 6.4 |
| VII | 11.8 |
| VIII | 17.6 |

TABLE I-continued

| EXAMPLE | PEEL STRENGTH (gm/cm) |
|---|---|
| IX (Control) | 6.2 |
| X | 10.5 |
| XII | 12.8 |
| XIII (Control) | 15.7 |
| XIV | 22.5 |
| XV | 28.1 |
| XVI | 35.5 |

*The resulting imaging member, having omitted the adhesive layer, exhibits spontaneous layer delamination.

The effect of copolyester adhesive doping in the charge generating layer of a selenium dispersion has been evaluated by transmission electron microscopy (TEM). Examination at 50,000 times magnification shows that the integrity of homogeneous selenium particle dispersion in the charge generating layers is not affected by copolyester doping between 5 and 15 percent by volume.

EXAMPLE XVIII

The photoconductive imaging members fabricated using the present invention concept as described in Examples III through VIII, X through XII and XIV through XVI, along with the control imaging members of Comparative Examples I, II, IX and XIII, are examined for their electrophotographic performances using a xerographic scanner at 21° C. and 40% relative humidity. The results, after 50,000 cycles of testing, of charge acceptance, dark decay potential, background and residual voltages, photosensitivity, photo-induced discharge characteristics, and long term electrical cyclic stability for all invention imaging members are equivalent to those obtained for the control imaging member counterpart, indicating that the photoelectrical integrity of the original photoconductive imaging member has been maintained.

While the invention has been described with reference to particular preferred embodiments, the invention is not limited to the specific examples given, and other embodiments and modifications can be made by those skilled in the art without departing from the spirit and scope of the invention and the claims.

What is claimed is:

1. An electrophotographic imaging member, comprising a charge generating layer comprised of a film-forming binder, a photogenerating pigment, and a copolyester adhesive dopant which is different from said binder.

2. The imaging member of claim 1, wherein said binder is selected from the group consisting of polyvinylcarbazole, polyvinylbutyral, polystyrene and polystyrenebutadiene.

3. The imaging member of claim 1, wherein said photogenerating pigment is selenium or selenium alloy.

4. The imaging member of claim 1, wherein said copolyester adhesive dopant is present in an amount of about 0.1 volume percent to about 20 volume percent.

5. The imaging member of claim 1, further comprising an adhesive layer between a charge blocking layer and said charge generating layer.

6. The imaging member of claim 5, wherein said charge blocking layer comprises a silane.

7. The imaging member of claim 5, wherein said adhesive layer comprises a material which is different from, but chemically similar to, said copolyester adhesive dopant in said charge generating layer.

8. The imaging member of claim 5, wherein said adhesive layer has a thickness of about 0.01 micrometer to about 0.3 micrometer.

9. The imaging member of claim 5, wherein said adhesive layer comprises a copolyester.

10. The electrophotographic imaging member of claim 1, wherein said copolyester adhesive dopant is a linear saturated copolyester having a molecular structure represented as $$HO-\overset{O}{\overset{\|}{C}}-[\text{diacid-ethylene glycol}]_n OH$$

where n is a number which represents the degree of polymerization.

11. An electrophotographic imaging member, comprising a supporting substrate, a conductive layer, a charge blocking layer, a charge generating layer, and a charge transport layer, said imaging member not containing an adhesive layer between said charge generating layer and said blocking layer, wherein said charge generating layer comprises a film forming binder, a photogenerating pigment and a copolyester adhesive dopant.

12. The imaging member of claim 11, wherein said binder is polyvinylcarbazole.

13. The imaging member of claim 11, wherein said photogenerating pigment is selenium or selenium alloy.

14. The imaging member of claim 11, wherein said copolyester adhesive dopant is present in an amount of about 0.1 volume percent to about 20 volume percent.

15. The imaging member of claim 11, wherein said charge blocking layer comprises a silane.

16. The electrophotographic imaging member of claim 11, wherein said copolyester adhesive dopant is a linear saturated copolyester having a molecular structure represented as $$HO-\overset{O}{\overset{\|}{C}}-[\text{diacid-ethylene glycol}]_n OH$$

where n is a number which represents the degree of polymerization.

17. An electrophotographic imaging member, comprising a supporting substrate, a conductive layer, a charge blocking layer, an adhesive layer, a charge generating layer, and a charge transport layer, wherein said charge generating layer comprises a film-forming binder, photogenerating pigment and a copolyester adhesive dopant.

18. The imaging member of claim 17, wherein said binder is polyvinylcarbazole.

19. The imaging member of claim 17, wherein said photogenerating pigment is selenium or selenium alloy.

20. The imaging member of claim 17, wherein said copolyester adhesive dopant is a linear saturated copolyester of four diacids and ethylene glycol, having a molecular weight of about 70,000, and being present in an amount of about 0.1 volume percent to about 20 volume percent.

21. The imaging member of claim 17, wherein said copolyester adhesive dopant is a linear copolyester of two diacids and ethylene glycol, having a molecular weight of about 50,000, and being present in an amount of about 0.1 volume percent to about 20 volume percent.

22. The imaging member of claim 17, wherein said charge blocking layer comprises a silane.

23. The imaging member of claim 17, wherein said adhesive layer comprises a copolyester adhesive.

24. The imaging member of claim 23, wherein said copolyester of said adhesive layer and said copolyester adhesive dopant in said charge generating layer are different materials, but are chemically similar.

25. The electrophotographic imaging member of claim 17, wherein said copolyester adhesive dopant is a linear saturated copolyester having a molecular structure represented as $$HO-\overset{O}{\overset{\|}{C}}-[\text{diacid-ethylene glycol}]_n OH$$

where n is a number which represents the degree of polymerization.

* * * * *